US006510884B1

(12) United States Patent
Chan

(10) Patent No.: US 6,510,884 B1
(45) Date of Patent: Jan. 28, 2003

(54) ADHESIVE TAPE DISPENSER

(75) Inventor: Sik-Leung Chan, Tsuen Wan (CN)

(73) Assignee: C. C. & L Company Limited, Tsuen Wan (HK)

( * ) Notice: Subject to any disclaimer, the term of this patent is extended or adjusted under 35 U.S.C. 154(b) by 21 days.

(21) Appl. No.: 09/833,940

(22) Filed: Apr. 12, 2001

(51) Int. Cl.[7] ..... B32B 31/00

(52) U.S. Cl. ..... 156/527; 156/574; 156/577; 156/579; 242/588.6

(58) Field of Search ..... 156/523, 527, 156/574, 577, 579; 242/588.1, 588.2, 588.6

(56) References Cited

U.S. PATENT DOCUMENTS 3,790,760 A * 2/1974 Stiller ..... 356/335
3,960,643 A * 6/1976 Dargitz et al. ..... 156/390
4,097,328 A * 6/1978 Urushizaki ..... 156/523
4,345,966 A * 8/1982 Iiyama et al. ..... 156/523
4,486,263 A * 12/1984 Monzo Gomez ..... 156/523
4,792,375 A * 12/1988 Lin ..... 156/510
4,804,437 A * 2/1989 Tirtoprodjo et al. ..... 156/523
4,844,373 A * 7/1989 Fike, Sr. ..... 206/389
5,326,421 A * 7/1994 Taylor ..... 156/526
6,053,233 A * 4/2000 Lin ..... 156/523
6,336,491 B1 * 1/2002 Sakamoto ..... 156/523
6,363,990 B1 * 4/2002 Kozaki ..... 118/76

* cited by examiner

*Primary Examiner*—Mark A. Osele
(74) *Attorney, Agent, or Firm*—Alix, Yale & Ristas, LLP

(57) ABSTRACT

An adhesive tape dispenser has a lower compartment 10 with a bottom aperture 12 and a cutting blade 13 at one side of the aperture. Tape is dispensed through the aperture 12 and chosen length severed by the blade 13. The figure shows the situation where an end of a desired length is about to be severed by continuing to move the dispenser to the right. During dispensing, a pressure roller 18, mounted adjacent the aperture, is pressed down to press the tape firmly against an external surface and to space the tape away from the cutting blade 13 during dispensing.

7 Claims, 4 Drawing Sheets

ADHESIVE TAPE DISPENSER

Adhesive tape dispensers are commonly used in homes, shops and offices for closing off packaging or connecting sheets of paper or other articles together. The adhesive tape is supplied in hand palm sized rolls for dispensing tape from the roll in lengths as required. Typically dispensers are configured as "desk top" items available on hand for convenient use.

Normally a length of tape is pulled off the roll when required and a cutting blade provided for severing the tape across at a chosen point to release the length for application to close off a package or seal a letter flap, for example. Generally, the user has to visually assess the length of tape required when severing the tape and before carrying the length of tape to apply the tape to the package or letter. Such visual assessment is rarely completely accurate and so too much or too little tape is severed. Also, in "carrying" the length of tape to the point-of-use, the tape may twist or crinkle leading to an untidy package closure or letter seal. Finally, it is necessary as a separate step to press the tape firmly into position against the package or envelope. All in all, the dispensing of tape is far from convenient.

It is an object of the invention to overcome or at least reduce these problems.

SUMMARY OF THE INVENTION

According to the invention there is provided an adhesive tape dispenser having a lower compartment with an aperture at one end, a tape cutting blade extending across the aperture, a tape roll compartment that slidingly fits into the lower compartment to supply an end of a tape from the roll to feed out of the aperture, a pressure roller attached to the tape roll support compartment and mounted across the aperture adjacent the cutting blade for pressing the end of the tape against a surface to which a length of tape is to be applied, and resilient means arranged to bias the pressure roller upwards inside the lower compartment, such that when the tape support compartment is urged downwards and the dispenser moved sideways a length of tape is dispensed from the roll and pressed by the roller against said surface and when the roller is retracted by the resilient means the tape can press against the cutting blade and be severed.

The adhesive tape dispenser may include a lid pivotably connected at an opposite side of the lower compartment to the said one side, in which the lid releasably supports said tape roller compartment The resilient means may comprise a spring mounted between a bottom inner surface of the lower compartment and a bottom lower outer surface of the tape roll compartment The tape roll compartment may comprise two like opposing shells that close together to surround and support a tape roll An externally mounted riding roller may be positioned across the lower compartment adjacent the aperture on an opposite side of the aperture to the pressure roller.

BRIEF DESCRIPTION OF DRAWINGS

An adhesive tape dispenser according to the invention will now be described by way of example with reference to the accompanying drawings in which.

DETAILED DESCRIPTION OF PREFERRED EMBODIMENT

Figure 1:
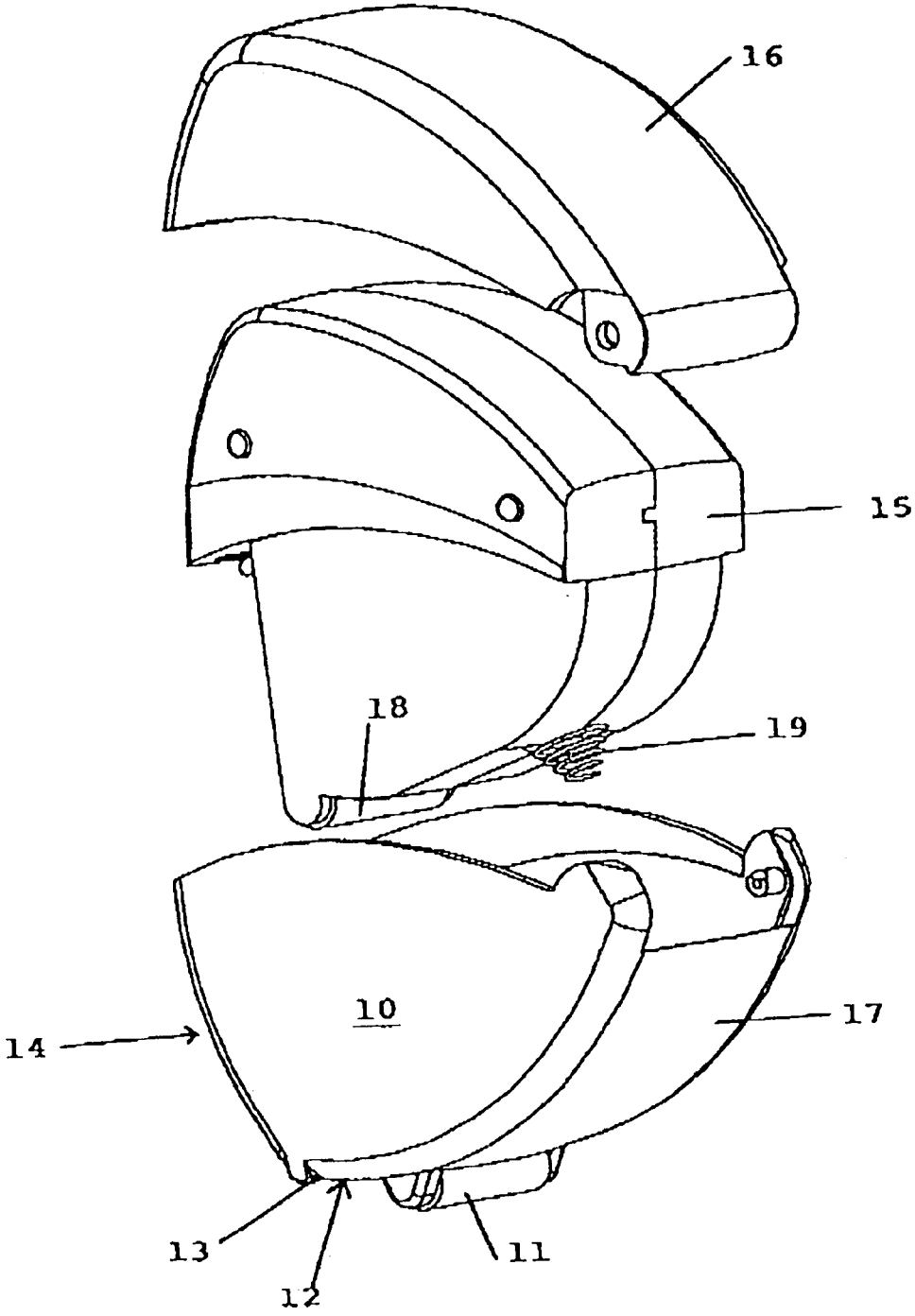
FIG. 1 is a partially exploded isometric view of the dispenser.

Referring to the drawings, in FIG. 1 a lower compartment 10 has a riding roller 11 mounted across a lower surface adjacent one side of an aperture 12 (better seen in FIG. 3 to 7). A cutting blade 13 is mounted to a front side 14 of the compartment 10, this at a "forward" side of the aperture 12.

A tape roll compartment 15 sliding fits into the compartment 10 and is releasably supported by a lid 16 that pivotably connects to a rear side 17 of the compartment 10. A pressure roller 18 is provided at a lower edge of the compartment 15 and a spring 19 resilient biasses the compartment 15 upwards with respect to the compartment 10.

Figure 2:
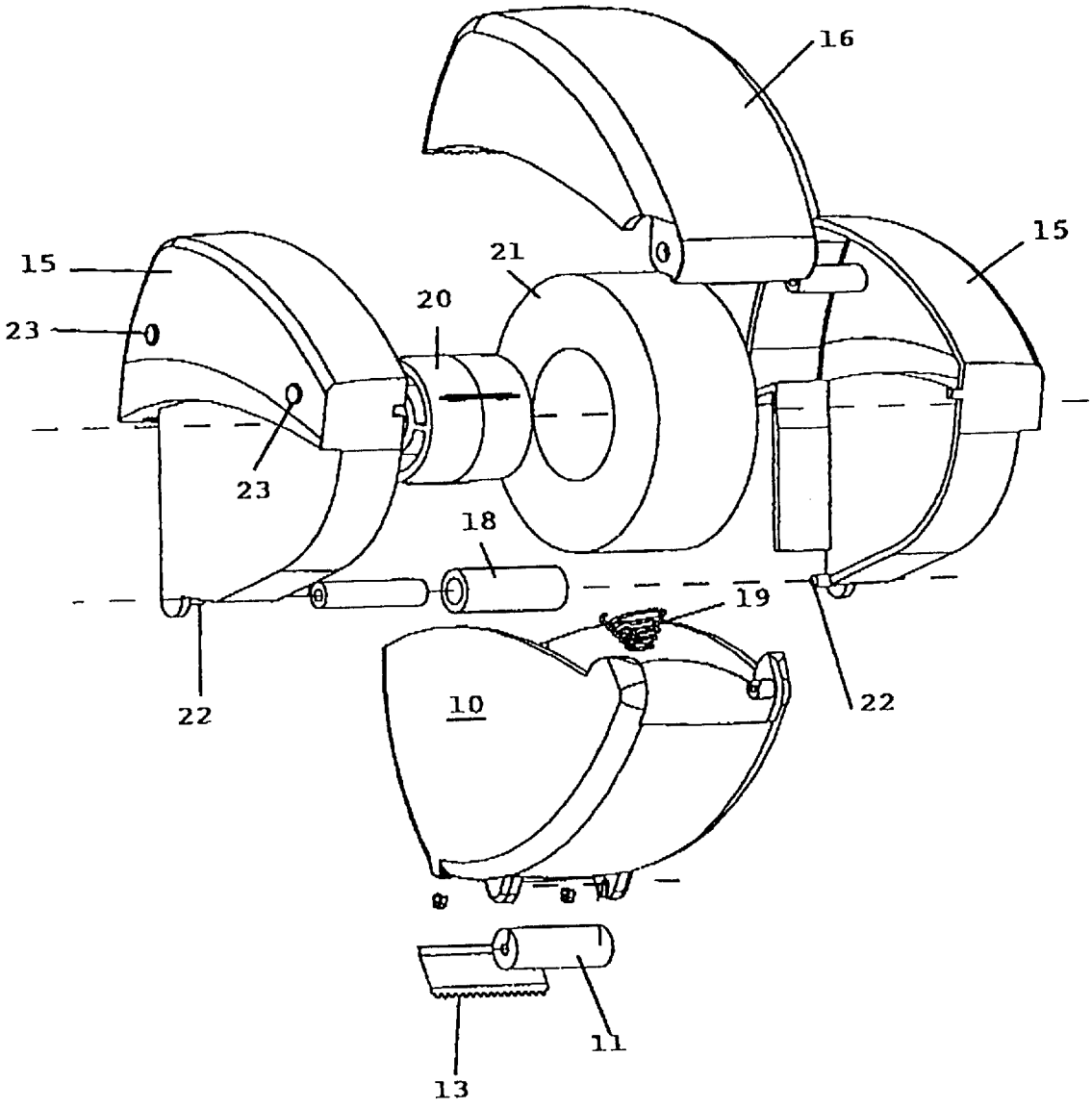
FIG. 2 is a fully exploded isometric view of the dispenser.

In FIG. 2, it can be seen that the compartment 15 consists of two like opposing shells that support an axle 20 to which a roll 21 of adhesive tape can be mounted for use. Integrally formed stub axles 22 are provided for the roller 18 and integrally formed pins 23 are provided to releasably hold the compartment 15 into the lid 16. When the compartment 15 is removed from the lid, the shells of the compartment separate for replenishing the roll 21, and to replace or readily clean the pressure roller 18, if required.

Figure 4:
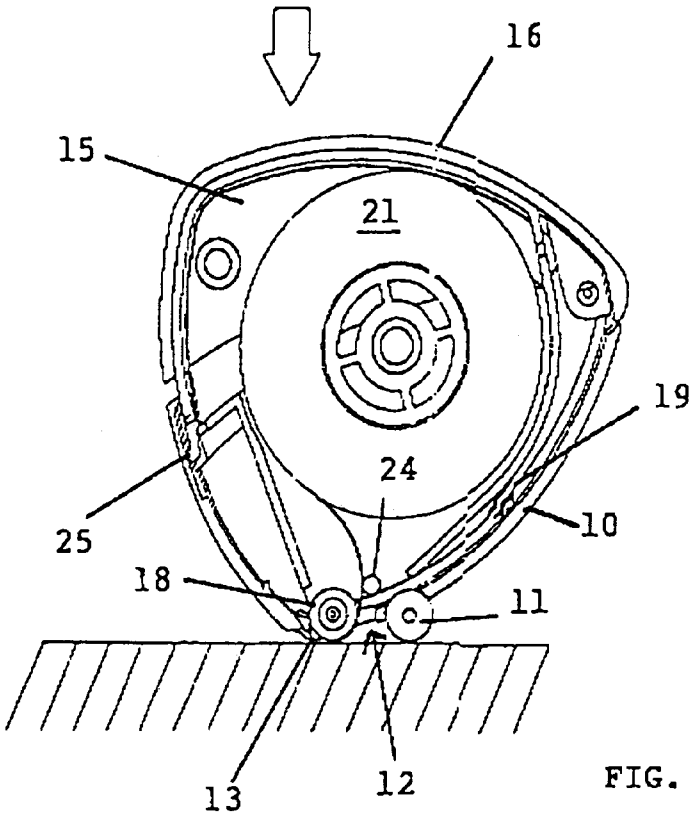
FIGS. 3 to 7 are five sequential sectional side views of the dispenser when carrying out a tape dispensing operation.
Figure 6:
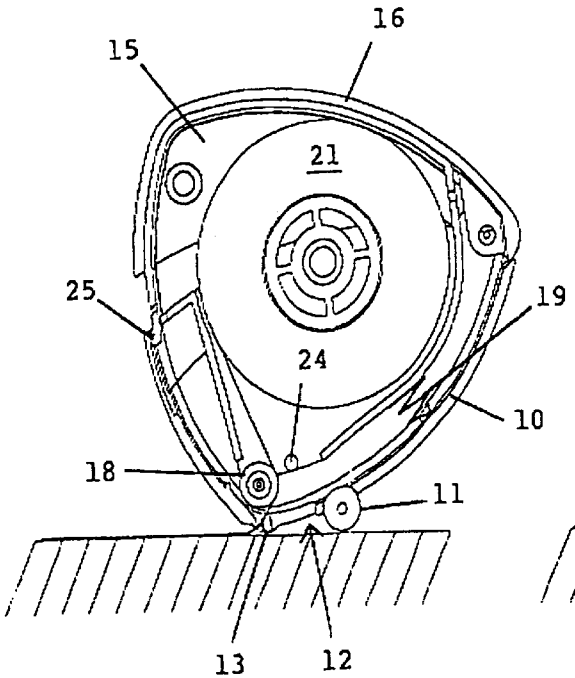
Figure 5:
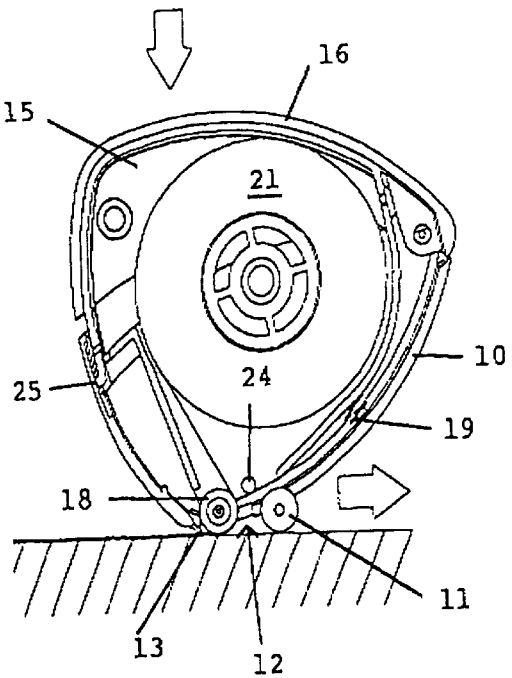

In FIGS. 3 to 7, the sequence of operation of the dispenser is shown. In the FIG. 3, the dispenser is placed against a surface at the point where the tape is to begin to being applied. The lid 16 is pressed downwards (FIG. 4) so as to press down the compartment 15, relative to the lower compartment 10, and compress the spring 19. As a result, the pressure roller 19 presses a leading end of the adhesive tape against the surface. The dispenser is then moved sideways, to the right, while pressing the tape and dispensing a length of tape against the surface (FIG. 5). The dispenser is arrested where the tape dispensing is to end and the lid 16 released to allow the spring 19 to urge the compartment 15, and the pressure roller 18, upwards (FIG. 6). As a result, the tape is engaged against the cutting blade 13 so that on further movement of the dispenser to the right (FIG. 7), the required length of tape is severed and firmly pressed against the surface along the full dispensed length.

Figure 3:
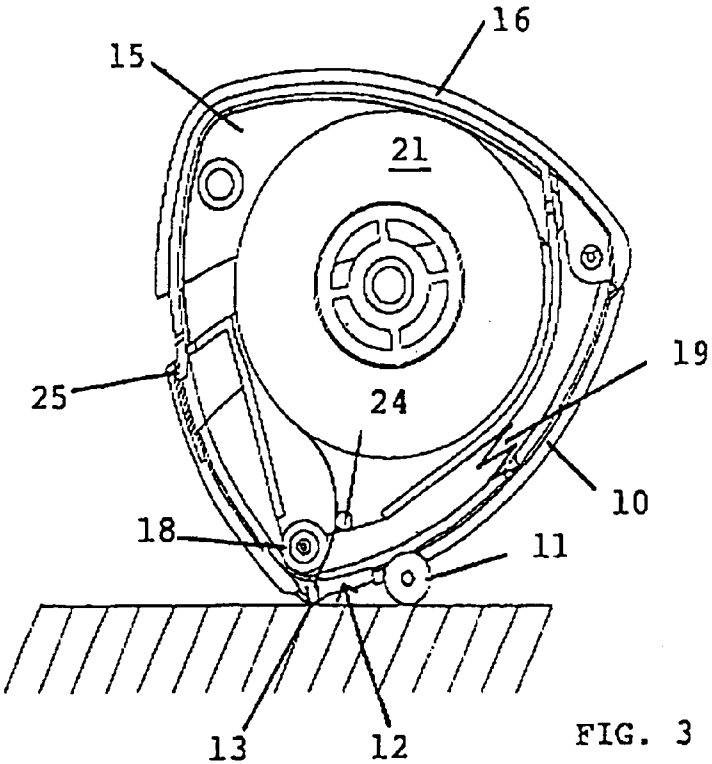
Figure 7:
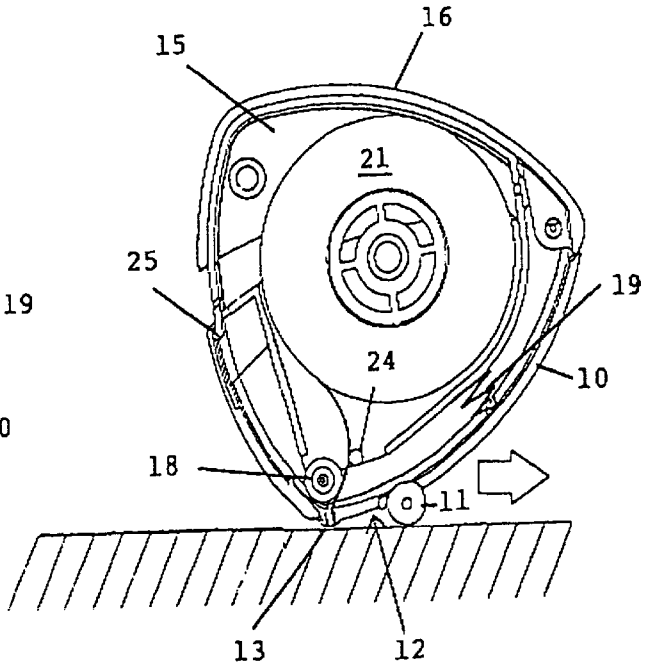

It will be noted that there is a small crossbar 24 that serves to hold a front tail end of the tape opposite the roller 18 (see FIGS. 3, 4 and 7). Because the crossbar 24 is touched by the adhesive side of the tape, the tail end is held sufficiently firmly in position during non-dispensing periods. An integrally formed spring clip 25 prevents the lid opening fully during normal operation of the dispenser.

The dispenser is capable of dispensing an (exactly) desired length of adhesive tape because the start and end of the dispensed tape is carried out in situ, that is as the tape is applied to the package or envelope, say. Also, as the tape is dispensed, it is firmly pressed and fixed to the surface requiring to be "taped". Operation of tape dispensing can be conveniently and satisfactionly carried out using one hand, leaving the other hand free to hold the package or envelope firmly in position for taping.

I claim:

1. An adhesive tape dispenser having a lower compartment with an aperture at one end, a tape cutting blade extending across the aperture, a tape roll compartment that slides into and out of the lower compartment to supply an end of a tape from the roll to feed out of the aperture, a pressure roller attached to the tape roll compartment and mounted across the aperture adjacent the cutting blade for pressing the end of the tape against a surface to which a length of tape is to be applied, and resilient means arranged to bias the pressure roller upwards inside the lower compartment, such that when the tape roll compartment is urged downwards and the dispenser moved sideways a length of tape is dispensed from the roll and pressed by the roller against said surface and when the roller is retracted by the resilient means the tape can press against the cutting blade and be severed.

2. An adhesive tape dispenser according to claim 1, including a lid pivotably connected at an opposite side of the lower compartment to the said one side, in which the lid releasably supports said tape roll compartment.

3. An adhesive tape dispenser according to claim 1, in which the resilient means comprise a spring mounted between a bottom inner surface of the lower compartment and a bottom lower outer surface of the tape roll compartment.

4. An adhesive tape dispenser according to claim 1 in which the tape roll compartment comprises two like opposing shells that close together to surround and support a tape roll.

5. An adhesive tape dispenser according to claim 1, including an externally mounted riding roller positioned across the lower compartment adjacent the aperture on an opposite side of the aperture to the pressure roller.

6. An adhesive tape dispenser having a lower compartment with an aperture at one end, a tape cutting blade extending across the aperture, a tape roll compartment that slidingly fits into the lower compartment to supply an end of a tape from the roll to feed out of the aperture, a pressure roller attached to the tape roll compartment and mounted across the aperture adjacent the cutting blade for pressing the end of the tape against a surface to which a length of tape is to be applied, a lid pivotably connected at an opposite side of the lower compartment to the said one side, in which the lid releasably supports said tape roll compartment and resilient means arranged to bias the pressure roller upwards inside the lower compartment, such that when the tape roll compartment is urged downwards and the dispenser moved sideways a length of tape is dispensed from the roll and pressed by the roller against said surface and when the roller is retracted by the resilient means the tape can press against the cutting blade and be severed.

7. An adhesive tape dispenser having a lower compartment with an aperture at one end, a tape cutting blade extending across the aperture, a tape roll compartment that slidingly fits into the lower compartment to supply an end of a tape from the roll to feed out of the aperture, a pressure roller attached to the tape roll compartment and mounted across the aperture adjacent the cutting blade for pressing the end of the tape against a surface to which a length of tape is to be applied, and resilient means arranged to bias the pressure roller upwards inside the lower compartment, the resilient means comprising a spring mounted between a bottom inner surface of the lower compartment and a bottom lower outer surface of the tape roll compartment, such that when the tape roll compartment is urged downwards and the dispenser moved sideways a length of tape is dispensed from the roll and pressed by the roller against said surface and when the roller is retracted by the resilient means the tape can press against the cutting blade and be severed.

* * * * *